US007401747B2

(12) United States Patent
Bai

(10) Patent No.: US 7,401,747 B2
(45) Date of Patent: Jul. 22, 2008

(54) BLADE PAIRS FOR A PAPER SHREDDER

(75) Inventor: Shuhui Bai, Jinjiang (CN)

(73) Assignee: Splendid Electronics (Shenzhen) Company Limited, Shenzhen (CN)

( * ) Notice: Subject to any disclaimer, the term of this patent is extended or adjusted under 35 U.S.C. 154(b) by 105 days.

(21) Appl. No.: 11/246,891

(22) Filed: Oct. 11, 2005

(65) Prior Publication Data

US 2006/0102763 A1 May 18, 2006

(30) Foreign Application Priority Data

Nov. 17, 2004 (CN) ..... 2004 2 0095527

(51) Int. Cl.
*B02C 18/16* (2006.01)

(52) U.S. Cl. ..... 241/295; 241/236

(58) Field of Classification Search ..... 241/295, 241/236

See application file for complete search history.

(56) References Cited

U.S. PATENT DOCUMENTS

| | | | | |
|---|---|---|---|---|
| 2,241,491 | A * | 5/1941 | Treloar | 241/243 |
| 5,676,321 | A * | 10/1997 | Kroger | 241/236 |
| 6,089,482 | A * | 7/2000 | Chang | 241/236 |
| 6,981,667 | B2 * | 1/2006 | Hunag | 241/295 |
| 2004/0140383 | A1 * | 7/2004 | Chang | 241/236 |
| 2007/0063084 | A1 * | 3/2007 | New | 241/295 |

* cited by examiner

*Primary Examiner*—Mark Rosenbaum

(57) ABSTRACT

Blade pairs for a paper shredder comprises two single blades with a flange rib on the surface of each blade, and the flange ribs of two single blades are against each other when shredding the paper. A hole is in the center of each blade. 2-8 corresponding blade points are arranged at the edge of each blade, which slant a certain degree beyond the plane of the blades, and the blade points of each blade pairs meet at a certain angle when assembled. Blade pairs is processed easily and it can save raw material.

13 Claims, 3 Drawing Sheets

BLADE PAIRS FOR A PAPER SHREDDER

BACKGROUND OF THE INVENTION

1. Field of the Invention

This invention generally relates to a blade, especially refers to blade pairs for paper shredder.

2. Description of the Related Art

People often need to destroy the file paper during their work and in their daily life, in order to prevent the files being disclosed, so shredder has been an important tool to get rid of files. Now there are two kinds of shedders, one is strip-cut shredder, the other is cross-cut shredder, they are either manual or electric. Cross-cut shredder is used to cut the waste paper into paper shreds. Normally a shredder blade includes two single blades which are against each other, the two single blades are fixed on the two parallel rotary shafts. When the shafts rotate, waste paper passes through the two single blades. In general, the thickness of two single blades equals to the width of shred, so the blade is too thick, and processing the blade needs more material.

SUMMARY OF THE INVENTION

An object of the present invention is to provide blade pairs for a shredder blade, said blade pairs has a simple structure, which is processed easily and can save raw material.

Blade pairs for a shredder blade according to the present invention comprises two single blades, a flange rib extending from a surface of each single blade, said flange ribs are against each other when the two single blades are assembled together, a mounting hole is defined in the middle of each blade, several corresponding blade points are around each blade. The blade points slant in certain degree beyond the plane of the blades, therefore, they meet at a certain angle when assembled. Because of the existence of flange ribs, the thickness of two single blades before assembled is less than that of pair blades when assembled.

Therein blade supports are defined on the blade surface, the blade supports are against the surface of the other blade, and they are set between two blade points at the edge of one blade.

The optimal number of blade points ranges from two to eight, and they are evenly distributed on the periphery of the blade.

The number of blade supports is equal to that of blade points.

The hole in the middle of each blade can be a dodecagon, hexagon or sawtooth.

Compared with the common paper shredder blade, the invention has the following features:

Each blade has a flange rib, the two flange ribs are against each other when assembled, the thickness of the pair blades when assembled is less than the width of the cutting size, therefore processing the blade can save raw material. What's more, there are a few supports between the blades, which can prevent the paper shreds flowing into the gap of the two blades. Furthermore, the precision of processing mold is not very high.

Other objects, advantages and novel features of the present invention will be drawn from the following detailed description of a preferred embodiment of the present invention, with attached drawings, in which:

DETAILED DESCRIPTION OF THE PREFERRED EMBODIMENT

Figure 1:
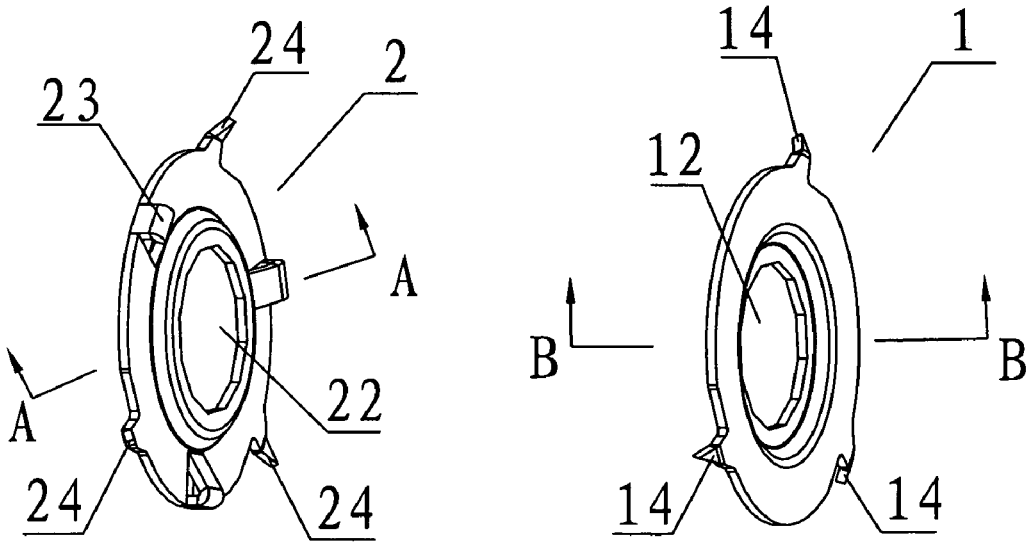
FIG. 1 is an exploded, perspective view of blade pairs.
Figure 2:
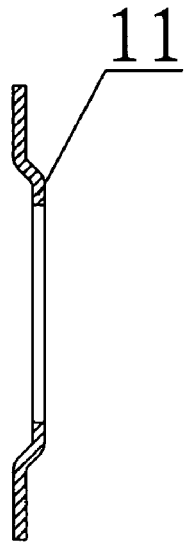
FIG. 2 is a side view of one blade of the invention.
Figure 3:
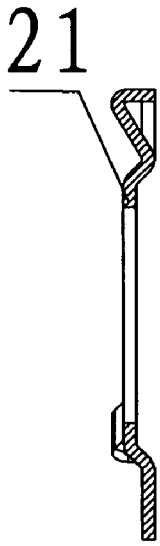
FIG. 3 is a side view of the other blade of the invention.

According to FIGS. 1, 2 and 3, blade pairs used for a paper shredder according to the present invention comprises two single blades 1 and 2.

There are two flange ribs 11 and 21 extending up from the surface of two blades, and the two flange ribs 11 and 21 are against each other when assembled together. The thickness of each blade is 0.8 mm, however the thickness of the pair blades when assembled is 4 mm because of the extra thickness of two flange ribs 11 and 21. There are two mounting holes 12 and 22 respectively defined in the middle of corresponding blade pairs 1 and 2, the two mounting holes 12 and 22 are dodecagon. Three pairs of corresponding blade points 14 and 24 extend from the surface of the blade pairs 1 and 2. They are arranged evenly around the mounting hole 11 and 21. The blade points 14 and 24 slant a certain degree beyond the plane of the blade pairs 1 and 2, therefore, they are against each other when the blade pairs 1 and 2 are assembled. There are three blade supports 23 on the blade 2.

Figure 4:
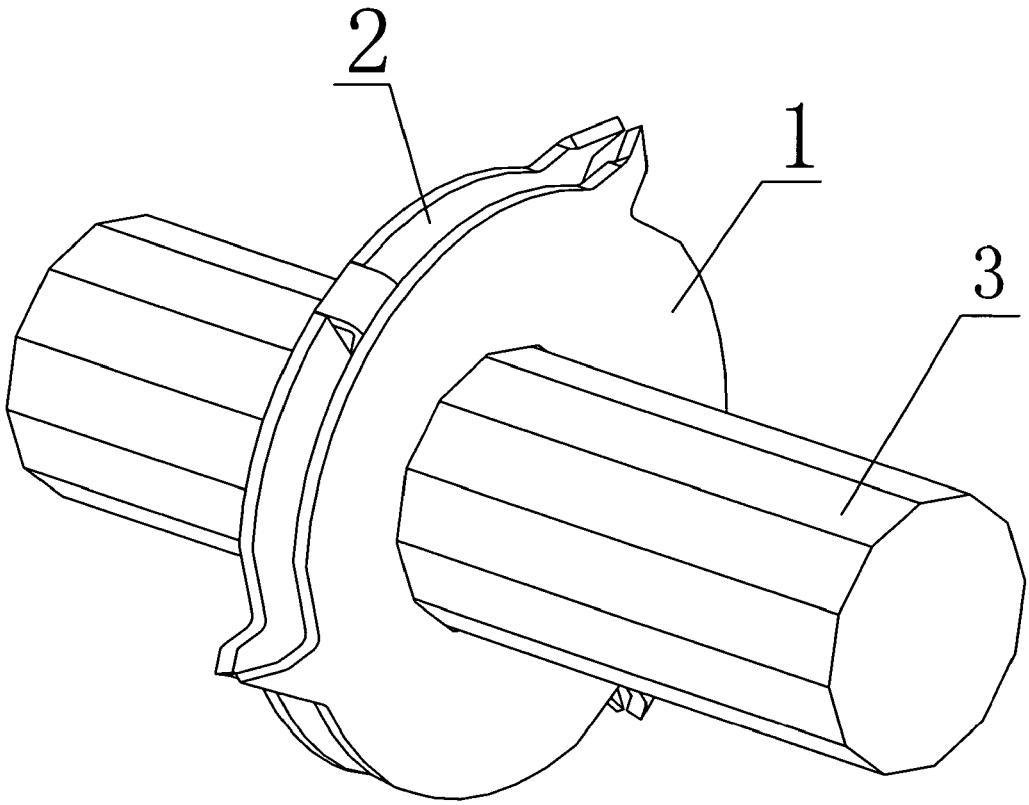
FIG. 4 is an assembled, perspective view of the present invention coupled to a shaft.

According to FIG. 4, the two single blades 1 and 2 are fixed onto the rotating shaft through the mounting holes 12 and 22, the shape of cross-section of the rotating shaft is also dodecagon, therefore, it goes well with the mounting holes 12 and 22.

The invention claimed is:

1. Blade pairs for a paper shredder comprising:

two single blades, each of the two single blades defining a plane; and at least two blade points positioned at a periphery of each of the two single blades, the blade points extending out from and angled with respect to the plane;

wherein each of the two single blades comprises a flange rib extending respectively from the surfaces of the each of the two single blades, and a mounting hole defined substantially in the middle of each of the two single blades, and wherein on the periphery of one of the two single blades there are blade supports located between the at least two blade points of the blade, and the blade supports of one blade are attached to the surface of the other blade.

2. The blade pairs as claimed in claim 1, wherein the number of blade points of each of the two single blades is the same.

3. The blade pairs as claimed in claim 1, wherein the at least two blade points comprise three corresponding blade points on each of the two single blades.

4. The blade pairs as claimed in claim 1, wherein the blade supports comprise three blade supports on at least one of the two single blades.

5. The blade pairs as claimed in claim 1, wherein the shape of the mounting holes are dodecagon.

6. Blade pairs for adjacent mounting on a blade shaft of a paper shredder, the blade pairs comprising:

a first blade defining a first plane and defining a substantially circular periphery, the first blade comprising a plurality of blade points extending away from the circular periphery and extending away from and angled with respect to the first plane, and a mounting aperture configured to receive the shaft of the paper shredder; and a second blade for mounting adjacent to the first blade, the second blade defining a second plane and defining a substantially circular periphery, the second blade comprising a plurality of blade points extending away from the circular periphery and extending away from and angled with respect to the second plane, and a mounting aperture configured to receive the shaft of the paper shredder;

wherein at least one of the first blade and the second blade further comprises a flange rib extending away from at least one of the first plane and the second plane in the direction of the blade points for contacting the other of the first blade and the second blade when mounted adjacent thereto, wherein the first plane and the second plane are spaced; and wherein at least one of the first blade and the second blade comprises a plurality of blade supports arranged substantially along the circular periphery of the at least one of the first blade and the second blade, the blade supports extending away from the at least one of the first blade and the second blade for contacting the other of the at least one of the first blade and the second blade when mounted adjacent thereto.

7. The blade pairs of claim 6, wherein the plurality of blade points of the first blade and the second blade comprise sharp, substantially triangular points jutting away from the circular periphery of the first blade and the circular periphery of the second blade respectively.

8. The blade pairs of claim 6, wherein the first blade and the second blade are formed of metallic sheet material having a substantially uniform thickness.

9. The blade pairs of claim 6, wherein the flange rib comprises a substantially circular indentation surrounding the mounting aperture of the at least one of the first blade and the second blade.

10. A combination blade pair and blade shaft for a paper shredder, the combination comprising:

a blade shaft having an axis of rotation;

a first blade connected to the blade shaft, the first blade defining a first plane substantially perpendicular to the axis of rotation of the shaft and defining a substantially circular periphery, the first blade comprising a plurality of blade points extending away from the circular periphery and extending away from and angled with respect to the first plane, and a flange rib extending away from the first plane in the direction of the blade points; and a second blade connected to the blade shaft adjacent to the first blade, the second blade defining a second plane substantially perpendicular to the axis of rotation of the shaft and defining a substantially circular periphery, the second blade comprising a plurality of blade points extending away from the circular periphery and extending away from and angled with respect to the second plane, and a flange rib extending away from the second plane in the direction of the blade points, the flange rib of the second blade contacting the flange rib of the first blade, wherein the first plane is spaced from the second plane;

wherein the plurality of blade points of the first blade extend toward the second plane and wherein the plurality of blade points of the second blade extend toward the first plane, and wherein the plurality of blade points of the first blade are substantially aligned with the plurality of blade points of the second blade along the circular periphery of the first blade and the circular periphery of the second; blade and wherein at least one of the first blade and the second blade comprises a plurality of blade supports arranged substantially along the circular periphery of the at least one of the first blade and the second blade, the blade supports extending away from the at least one of the first blade and the second blade in the direction of the blade points, wherein the blade supports contact the other of the at least one of the first blade and the second blade.

11. The combination of claim 10, wherein the plurality of blade points of the first blade and the second blade comprise sharp, substantially triangular points jutting away from the circular periphery of the first blade and the circular periphery of the second blade respectively, wherein the triangular points of the first blade are in close proximity to the triangular points of the second blade.

12. The combination of claim 10, wherein the first blade comprises a first mounting aperture receiving the blade shaft and the second blade comprises a second mounting aperture receiving the blade shaft, and wherein the flange rib of the first blade is positioned adjacent to the mounting aperture of the first blade spaced from the blade supports, and the flange rib of the second blade is positioned adjacent to the mounting aperture of the second blade spaced from the blade supports.

13. The combination of claim 10, wherein the first blade and the second blade are formed of metallic sheet material having a substantially uniform thickness.

* * * * *